US008128048B2

(12) United States Patent
Odishoo

(10) Patent No.: US 8,128,048 B2
(45) Date of Patent: Mar. 6, 2012

(54) MOUNTABLE BOX HOLDER AND METHOD FOR MOUNTING A BOX

(76) Inventor: Pera Odishoo, Chicago, IL (US)

( * ) Notice: Subject to any disclaimer, the term of this patent is extended or adjusted under 35 U.S.C. 154(b) by 105 days.

(21) Appl. No.: 12/095,796

(22) PCT Filed: Dec. 1, 2006

(86) PCT No.: PCT/US2006/061473

§ 371 (c)(1),
(2), (4) Date: Oct. 15, 2008

(87) PCT Pub. No.: WO2007/065148

PCT Pub. Date: Jun. 7, 2007

(65) Prior Publication Data

US 2009/0134296 A1 May 28, 2009

Related U.S. Application Data

(60) Provisional application No. 60/741,799, filed on Dec. 2, 2005.

(51) Int. Cl.
*A47G 1/10* (2006.01)

(52) U.S. Cl. ..... 248/316.7; 248/903; 248/684; 248/905

(58) Field of Classification Search ..... 248/316.7, 248/684, 905, 309.1, 216.1, 231.91, 903; 221/46

See application file for complete search history.

(56) References Cited

U.S. PATENT DOCUMENTS

| | | | | |
|---|---|---|---|---|
| 1,911,934 | A * | 5/1933 | Van Ostrand et al. | 248/305 |
| 3,110,467 | A * | 11/1963 | Dube | 248/311.2 |
| 3,395,428 | A | 8/1968 | Schnabel | |
| 3,724,716 | A | 4/1973 | Baraconi et al. | |
| 4,176,817 | A | 12/1979 | Jones | |
| 4,177,910 | A * | 12/1979 | Gangl | 224/668 |
| 5,573,216 | A | 11/1996 | Kuroda | |
| 5,823,497 | A | 10/1998 | Weatherhead | |
| 6,641,100 | B2 * | 11/2003 | Furukawa | 248/309.1 |
| 7,281,696 | B2 * | 10/2007 | Kida et al. | 248/300 |
| 2004/0099623 | A1 * | 5/2004 | Kurtz et al. | 211/85.17 |
| 2004/0245421 | A1 | 12/2004 | Turvey | |

FOREIGN PATENT DOCUMENTS

GB 05995 0/1911

OTHER PUBLICATIONS

European Search Report dated May 20, 2010, European Patent Application No. 06840093.6.

* cited by examiner

*Primary Examiner* — Ramon Ramirez
(74) *Attorney, Agent, or Firm* — Mitchell Law PLLC; Matthew W. Mitchell

(57) ABSTRACT

A box holder for mounting a box, such as a tissue box, on a surface is provided. The box includes a wall having a slot formed or pre-formed thereon. The box holder has structure for mounting to a surface, specifically an upper portion having a front edge and a base portion having a fastener to mount the box holder to the surface. The front edge is adaptable for insertion through the slot thereby allowing the box to be mounted on the box holder.

21 Claims, 7 Drawing Sheets

MOUNTABLE BOX HOLDER AND METHOD FOR MOUNTING A BOX

RELATED APPLICATION

The present application claims the benefit of U.S. Provisional Patent Application No. 60/741,799, filed Dec. 2, 2005, the entire contents of which are hereby incorporated by reference.

FIELD OF THE INVENTION

A box holder, and more particularly, a method and apparatus for mounting a box containing tissue paper or other contents therein to a surface in various orientations are disclosed.

BACKGROUND

An individual may have many uses for mounting a small to medium-sized box, such as a tissue box, at work or in the home on a daily basis. Typically, a tissue box is placed in a location, such as on a bathroom toilet tank or in a desk drawer, where visibility is low but access is inconvenient. A tissue box can also be placed in more easily accessible locations, such as on top of a coffee or end table or on a kitchen counter. Leaving a box in such a place not only may reduce a room's aesthetically pleasing decor, the tissue box may also take up valuable space. In addition, tissue boxes can easily be misplaced and inconvenient to locate when most needed. Thus, mounting a box containing tissue paper or other content to a surface such as the underside of a cabinet or desk, or on a wall or a table, could create convenient access, reduce the conspicuous presence of a tissue box, and generate more useful work and storage space.

One aspect of creating an effective box holder is to ensure that the box is securely mounted, while at the same time leaving its contents undisturbed during mounting. To attempt to securely mount a box, some box holders may grip the exterior surfaces of the box. These box holders, however, are generally large, highly visible, and aesthetically displeasing even while the box is mounted. Other box holders may have sharp edges which must puncture the box for mounting. Although these box holders may secure the box, the sharp edges may rearrange or damage the content of the box as well as cause the box itself to be needlessly mutilated. Rearranging the contents such as tissue paper may make removal more difficult. In addition, box holders with sharp edges may potentially cause injury or require extraordinary care and precision in aligning the box. Still other box holders may attempt to secure the box using a plate or other device that is much smaller than the box itself. In such cases, the box may shift quite readily after mounting.

Therefore, a need exists to manufacture a box holder that not only securely mounts the box but remains inconspicuous. Such a box holder should be inexpensive, durable, safe and easy to use, and should not disturb the contents of the box when the box is mounted. In addition, the box holder should be mountable on a variety of surfaces and in a variety of orientations.

SUMMARY

In general, a method and a box holder for mounting a box, such as a tissue box, to a surface are described. The box may have a wall and an opening formed in the wall configured to receive the box holder. The box holder generally may comprise a plate member and a base portion. In particular, the plate member may comprise a top surface and a bottom surface, the bottom surface facing the mounting surface. The plate member further may comprise an upper portion connected to the base portion, the upper portion of the plate member being received in the opening of the box. The base portion particularly may comprise a fastener mechanism and a spacing member. The fastener mechanism may be configured to attach the box holder to the mounting surface. The spacing member may be configured to provide a space between the bottom surface of the box holder and the mounting surface for accommodating a portion of the wall of the box when the box holder is attached to the mounting surface and when the upper portion of the plate member is inserted into an opening in the wall of the box.

The box holder may have, but is not limited to, a rectangular shape. In particular, the upper portion may include a front edge and a curved portion. The front edge may be curved away from a mounting surface and may include two rounded corners that reduce the total width of the front edge. The rounded corners and curved portion may be thus configured to make insertion of the front edge into an opening on the box easier when the box holder is mounted to a surface. Preferably, the opening on the box may be, but is not limited to, a linear slot along the width of the bottom wall of the box. The slot may be positioned away from a parallel edge of a wall of the box to assure that the box holder, when inserted, does not compress or disturb the boxed content.

The base portion may include a fastener for affixing the box holder to a surface. The fastener may be a set of holes through which a nail or screw can be inserted. The fastener may also be an adhesive on the bottom surface of the base portion that affixes the box holder to the surface.

Further, a spacing member may be disposed on the box member in order to facilitate the full insertion of the box onto the box holder. The spacing member may be an upper portion that is slightly arched to create a more pronounced space between the upper portion and a mounting surface. This arched upper portion may be configured to flex in order to facilitate the insertion of the box holder into the box. Consequently, the box holder may be composed of a flexible plastic or metal. The spacing member may also be formed by folding the back edge of the base portion underneath the bottom surface of the box holder so that it serves as a wedge between the box holder and the mounting surface. The spacing member may alternatively consist of a depressed rim that surrounds each of the mounting holes. This depressed rim would maintain contact with the mounting surface but leave a space between the bottom surface of the box holder and the mounting surface.

Further, the box holder may contain a reinforcing rib structure configured to improve the strength of the box holder. In particular, this rib structure may include a linear section of the box holder being raised above the top surface. The rib structure may substantially span the length of the upper portion of the box holder.

Further still, a separate stabilizing member may be affixed to the mounting surface a certain distance from the front edge of the box holder to assist in keeping the box in a stable position. In particular, the stabilizing member may be a pivoting piece having a pointed end. The stabilizing member may be mounted opposite the front edge so that when the stabilizing member pivots, the pointed end may slightly puncture the wall of the mounted box and remain lodged in the puncture, further retaining the box.

BRIEF DESCRIPTION OF THE DRAWINGS

FIG. 11 is a plan view of the box holder shown in FIG. 10.

Figure 1:
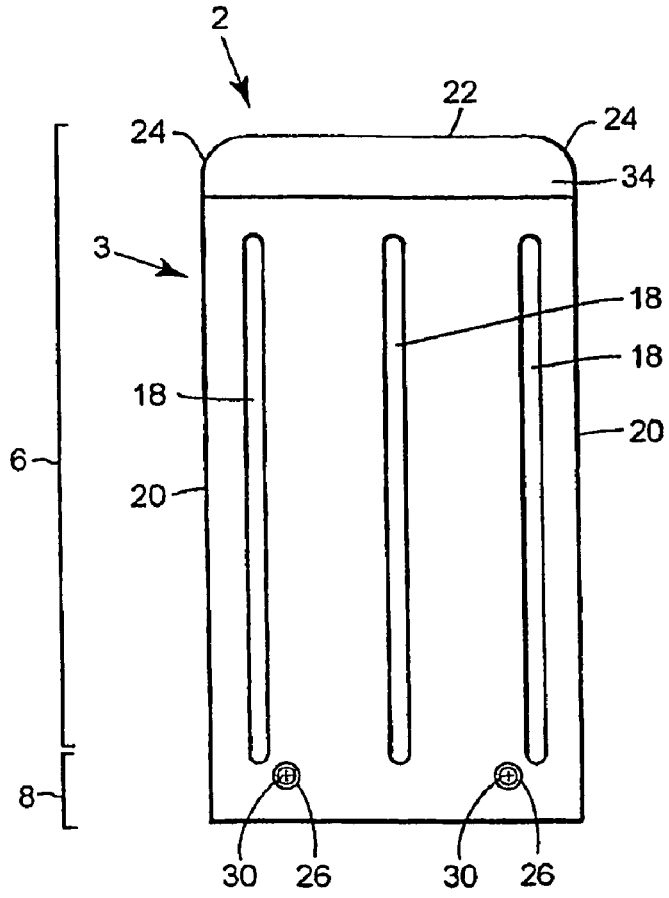
FIG. 1 is a plan view of a box holder.

Before at least one embodiment of the invention is explained in detail, it is to be understood that the invention is not limited in its application to the details of the construction and the arrangements of the components set forth in the following description or illustrated in the drawings. The invention is capable of other embodiments and of being practiced or carried out in various ways. Also, it is understood that the phraseology and terminology used herein is for the purpose of description and should not be regarded as limiting.

DETAILED DESCRIPTION

Figure 2:
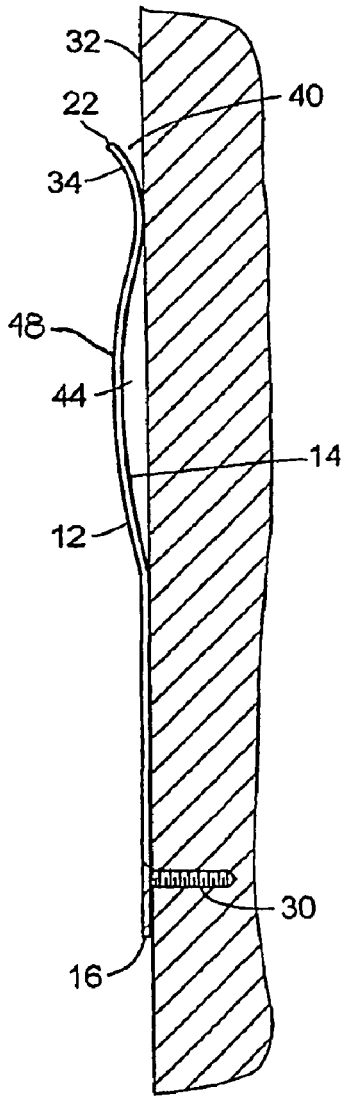
FIG. 2 is a sectional view of the box holder affixed to a mounting surface.
Figure 12:
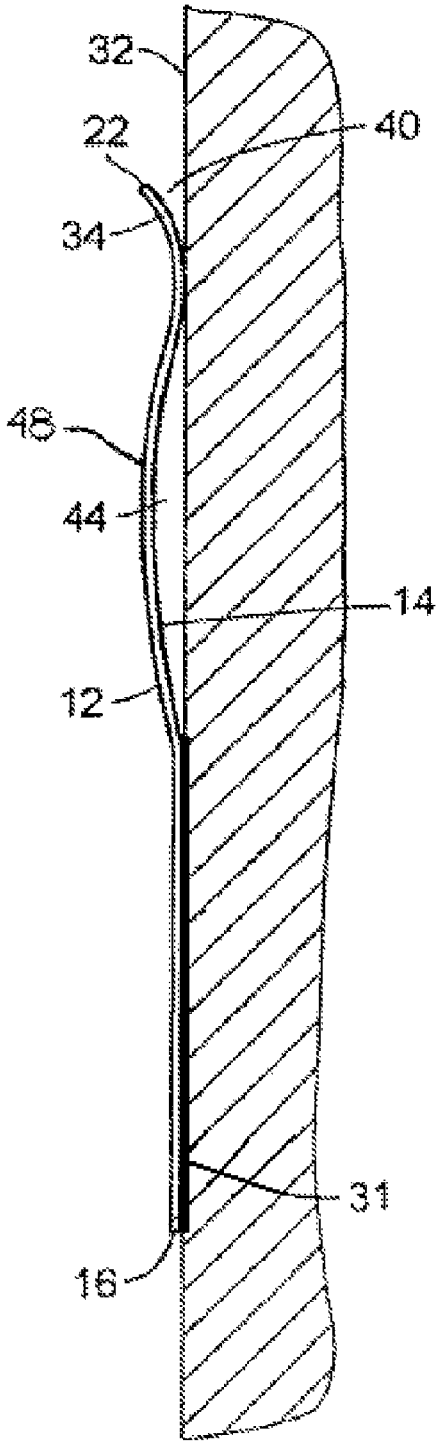
FIG. 12 is a sectional view of the box holder affixed to a mounting surface with adhesive.

Referring to FIGS. 1 and 2, a box holder 2 has a plate member 3 that comprises a top surface 12 and a bottom surface 14 thereon, and a peripheral edge therebetween as shown. The peripheral edge includes a back edge 16, two side edges 20, and a front edge 22. At the junction of the side edges 20 and the front edge 22 are two rounded corners 24 for facilitating the mounting of a box. The box holder 2 has mounting holes 26 spaced from the back edge 16 of the box holder 2. Screws 30 are used to mount the box holder 2 to a mounting surface 32, such as a wall. Nails or an adhesive 31 (see FIG. 12) may also be used to mount the box holder 2 to the wall. To provide additional strength, the box holder 2 also may have ribs 18 formed thereon.

As seen in FIG. 1, an upper portion 6 of the box holder 2 has a tip region 34 curved away from the mounting surface 32. Thus, as shown in FIG. 2, the tip region 34 is biased away from the mounting surface 32 forming a first space 40 between the front edge 22 and the mounting surface 32.

Figure 3:
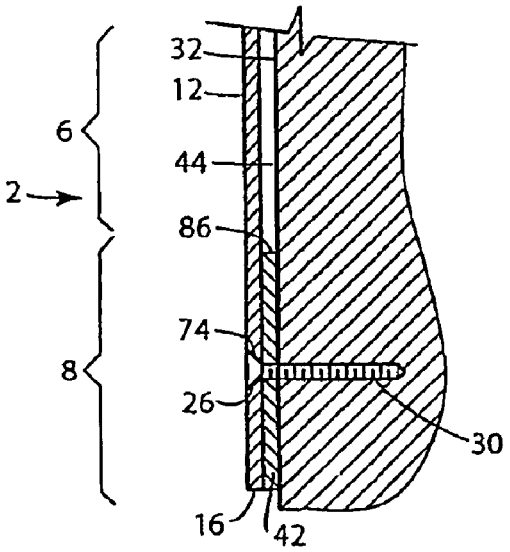
FIG. 3 is an enlarged partial sectional view of the box holder affixed to a mounting surface showing detail of a spacing member to space the box holder from the mounting surface in the form of a folded back edge of the box holder.

A folded portion 42 in the base portion 8 of the box holder 2 serves as a spacing member to extend a second space shown at 44 in FIG. 3. This spacing member may be formed by folding the back edge 86 underneath the bottom surface 14. Inclusion of the folded portion 42 extends the second space 44 shown in FIG. 2 between the box holder 2 and the mounting surface 32 to allow for mounting thick-walled boxes such as corrugated cardboard.

The second space 44 may be provided by another spacing member. As seen in FIG. 2, an arched portion 48 is located rearward of the tip region 34, the curved shape of the arched portion 48 forming the second space 44. In addition, the arched portion 48 acts to bias the upper portion 6 of the box holder 2 against mounting surface 32 to prevent accidental removal of an installed box.

Figure 4:
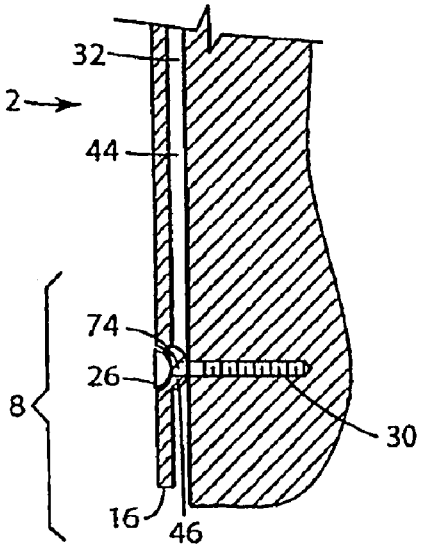
FIG. 4 is an enlarged partial sectional view of the box holder affixed to a mounting surface showing detail of a spacing member to space the box holder from the mounting surface in the form of a depressed rim.

The second space 44 may be provided by yet another spacing member. In FIG. 4, it can be seen that mounting holes 26 are formed having a depressed rim 46 there around projecting from the bottom surface 14 of the box holder 2. The depressed rim 46 contacts the mounting surface 32, preventing the bottom surface 14 from otherwise contacting the box holder 2, and thus provides the second space 44 between the box holder 2 and the mounting surface 32.

Further, it is advantageous that the screw 30 does not protrude above the top surface 12 of the box holder 2 by utilizing means such as a countersink 74 in the mounting hole 26, as shown in FIGS. 3 and 4, so that the head of the screw 30 does not interfere with the mounting of box 50.

Figure 8:
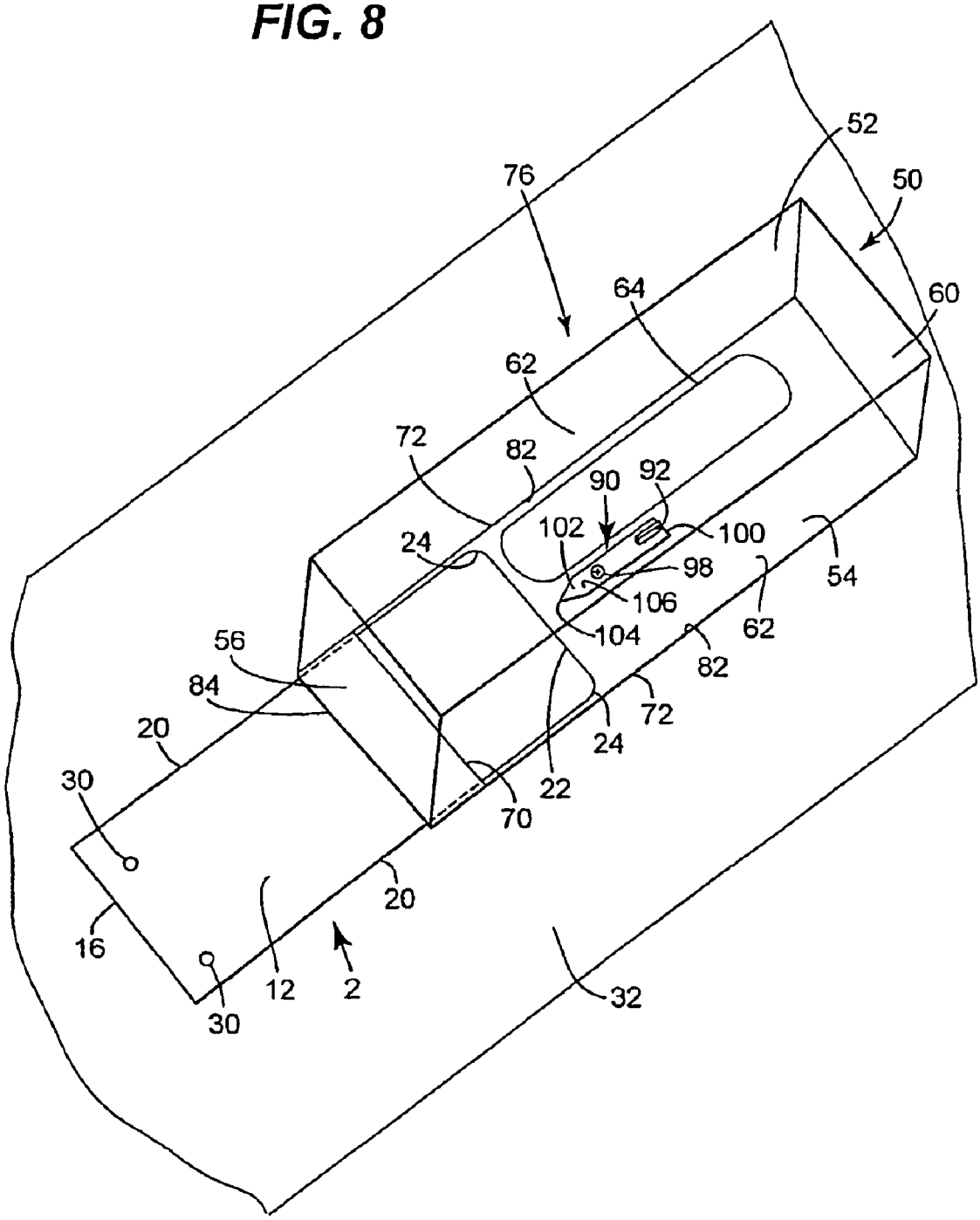
FIG. 8 is a perspective view of the box holder, the stabilizing member and tissue box shown in the process of being mounted on the box holder.
Figure 9:
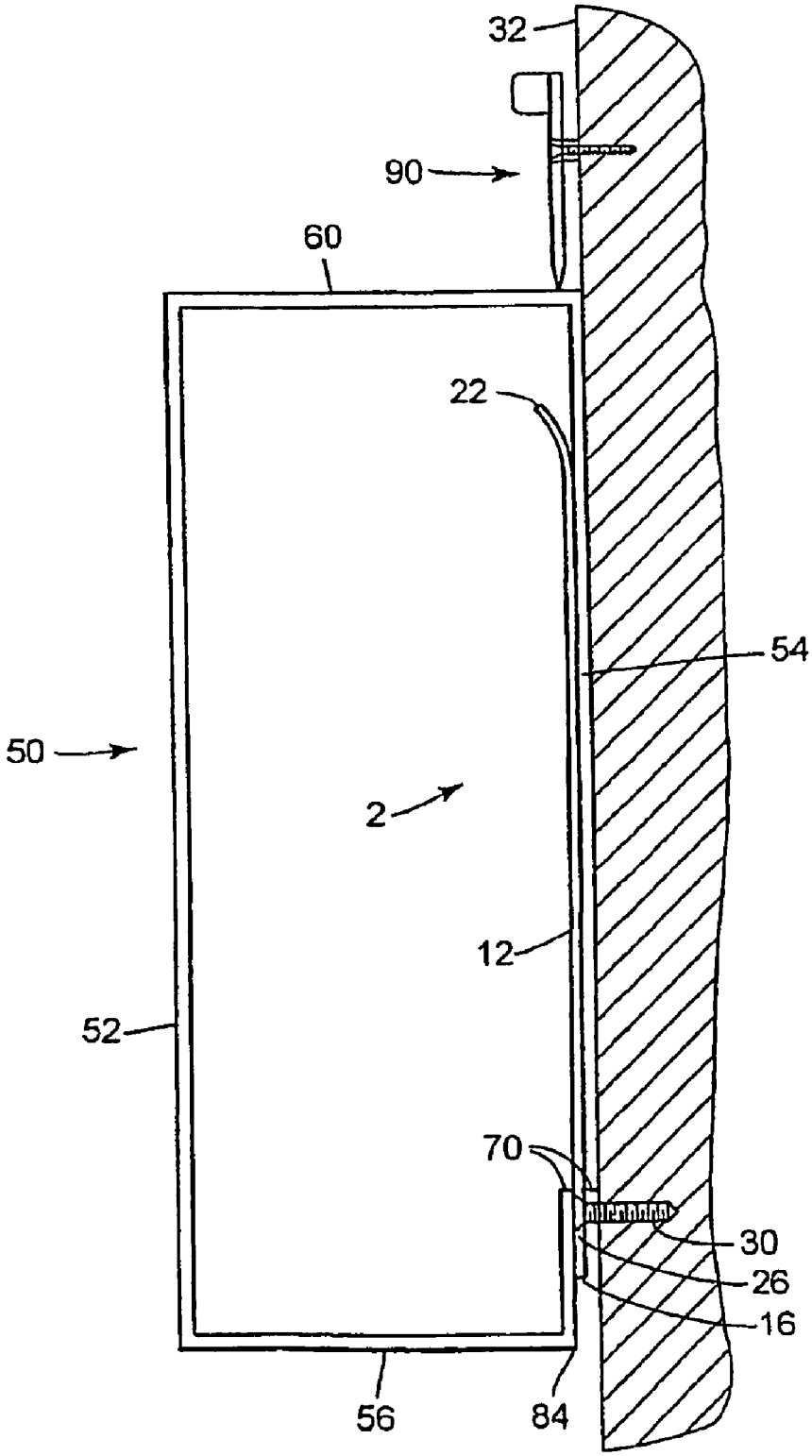
FIG. 9 is a sectional view of the box holder affixed to a mounting surface with a typical tissue box fully mounted onto the box holder.

Persons of ordinary skill in the art will recognize that a box such as a typical tissue box can be mounted on the box holder 2. As seen in FIGS. 8 and 9, a typical tissue box 50, for which the present box holder 2 is particularly suited, has a top wall 52, a bottom wall 54, a first end wall 56, a second end wall 60 and two lateral sidewalls 62. Referring particularly to FIG. 8, as is typical of such tissue boxes, there appears an opening 64 in the top wall 52 through which tissues 66 may be dispensed. Spaced from the first end wall 56, a slot 70 is provided in the bottom wall 54 of the box 50 to mount the box 50 to the box holder 2. The slot 70 may be created by the user or may be pre-formed or scored by the box manufacturer. The slot 70 can extend substantially along the entire width of the bottom wall 54 and should be formed a spaced distance from a first edge 84 of the first end wall 56. To accomplish this, the user may use two side edges 72 of bottom wall 54 and the first edge 84 of the first end wall 56 as a visual guide when forming the slot 70. The present box holder 2, therefore, allows the user relative ease and freedom in forming the slot To mount the box 50 on the box holder 2, as can be seen in FIGS. 8 and 9, a user slides the box 50 above the mounting surface 32 and along the box holder 2 in a manner which engages the front edge 22 into the slot 70. The rounded corners 24 provide the front edge 22 with a reduced width so as to allow easy insertion into the slot 70 of the box 50. A rear portion 76 of the bottom wall 54, i.e. the portion that is rearward of the slot 70, is initially directed into the first space 40. The curved shape of the front edge 22 of the box holder 2 then facilitates the further movement of the box holder 2 into the interior of the box 50. The front edge 22 directs the rear portion 76 of the bottom wall 54 into the second space 44 between the box holder 2 and the mounting surface 32. Once so directed, the second space 44 facilitates the continued sliding of the rearward portion 76 of the bottom wall 54 under the box holder 2. Depending on the elasticity of the material from which the box holder 2 is formed, the arched portion 48 of the box holder 2 temporarily flexes and flattens to further assist the rearward portion 76 of the bottom wall 54 in sliding underneath the bottom surface 14 of the box holder 2. The sliding action continues until the box 50 is restrained from further movement when the slot 70 engages the forward edge 86 of the folded portion 42, ending the mounting process. The sliding action may also be halted when the front edge 22 contacts the second end wall 60.

The side edges 20 of the box holder 2 should also act to substantially prevent lateral movement of the box 50, as seen in FIG. 8. Since the width of the box holder 2 should be substantially similar to the width of the box 50, the interior surfaces 82 of the lateral sidewalls 62 of the box 50 are in close proximity with the side edges 20 of the box holder 2 to thereby substantially restrain lateral movement of the box 50.

As shown in FIG. 8, it is advantageous that the slot 70 appears on the bottom wall 54 of the box 50 in a spaced relationship from the first end wall 56 of the box 50 for two reasons. First, the arrangement greatly reduces the chance that the front edge 22 of the box holder 2 will, upon the mounting of the box 50, tear or disturb tissues or other prepackaged contents, and hence later interfere with their removal. For instance, if the slot 70 was located at the bottom edge 84 of the first end wall 56, the front edge 22 of the box holder 2, upon insertion into the box 50, would likely engage or disturb tissues by catching an edge of the bottom tissue. Instead, the front edge 22 of the box holder 2 first contacts the bottom tissue along its bottom surface past the vicinity of the edge of the bottom tissue. Once contacting the bottom surface of the tissue, the box holder 2 is able to slide along the bottom surface of the bottom tissue until the box 50 is fully inserted along the box holder 2. The same advantage would exist for other boxes containing layered or spooled items, such as latex gloves or aluminum foil.

As seen in FIG. 9, a second advantage of spacing the slot 70 in the bottom wall 54 away from the first end wall 56 of the box 50 is that once the box 50 is fully mounted on the box holder 2, the box holder 2 is covered by the box 50 and is substantially hidden from view. The box 50 will entirely cover the top surface 12 of the box holder 2 if the length of the box holder 2 is less than or equal to the length of the tissue box, and the distance from the forward edge 86 of the folded portion 42 to the rear edge 16 is less than or equal to the distance between the slot 70 and the first end wall 56. When the box holder 2 is entirely hidden from view, matching the box holder's color and style to a room's decor is not at issue. This permits the box holder 2 to be constructed of an inexpensive plastic or metal. Nevertheless, the box holder 2 can also be designed using more expensive decorative materials that match a room's decor when a box is not mounted or insufficiently large to cover the entire box holder.

Further, the box holder 2 is constructed so as to be relatively thin. For example, the thickness of the box holder 2 may be on the order of the approximate thickness of a wall of a tissue box. A thin design will facilitate insertion of the box holder 2 into the slot 70 and also offers the ability to simultaneously package the box holder 2 with the box 50 as the box leaves the manufacturer. The box holder 2, for example, could be secured to a side of the box 50 but would not significantly increase the size of the packaging. Simultaneous packaging will also allow the combination of box 50 and the box holder 2 to be displayed on a store shelf without taking up significantly more space.

Figure 5:
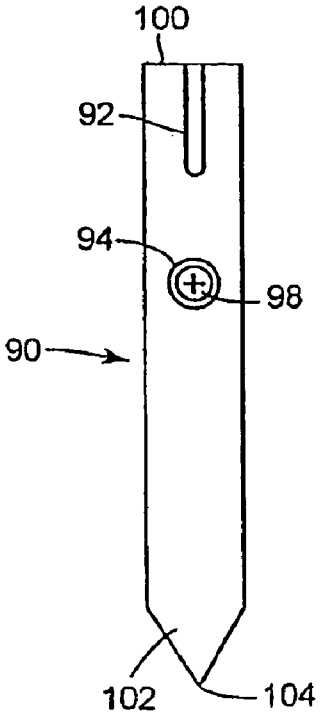
FIG. 5 is a plan view of a stabilizing member.
Figure 6:
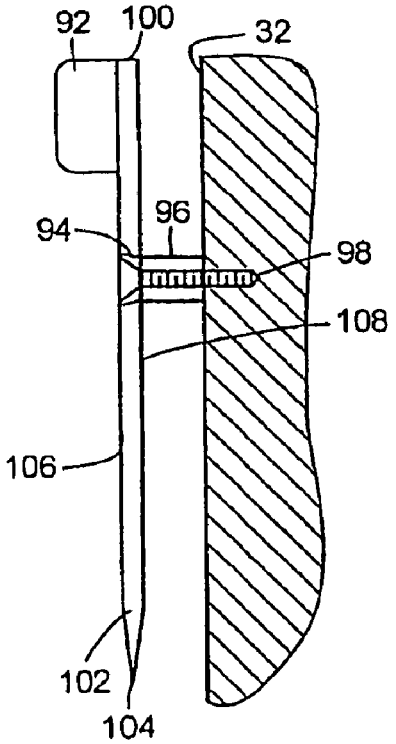
FIG. 6 is a sectional view of the stabilizing member.

Further still, a stabilizing member 90 is shown in FIGS. 5-9, to provide additional support to the box holder 2 when the box 50 is mounted. Referring particularly to FIGS. 5 and 6, the stabilizing member 90 has a flat shape with a handle 92 located at a top end 100 and a bottom end 102 having a pointed tip 104. A mounting hole 94 is located between the two ends through which a screw 98 may be inserted to secure the stabilizing member to the mounting surface 32. The stabilizing member 90 preferably pivots around the mounting hole 94. This pivoting action is facilitated by a hollow cylindrical extension 96 surrounding the bottom surface 108 of the mounting hole 94, through which the screw 98 is inserted prior to the screw 98 penetrating the mounting surface 32. Therefore, the stabilizing member 90 is biased from the mounting surface 32.

Figure 7:
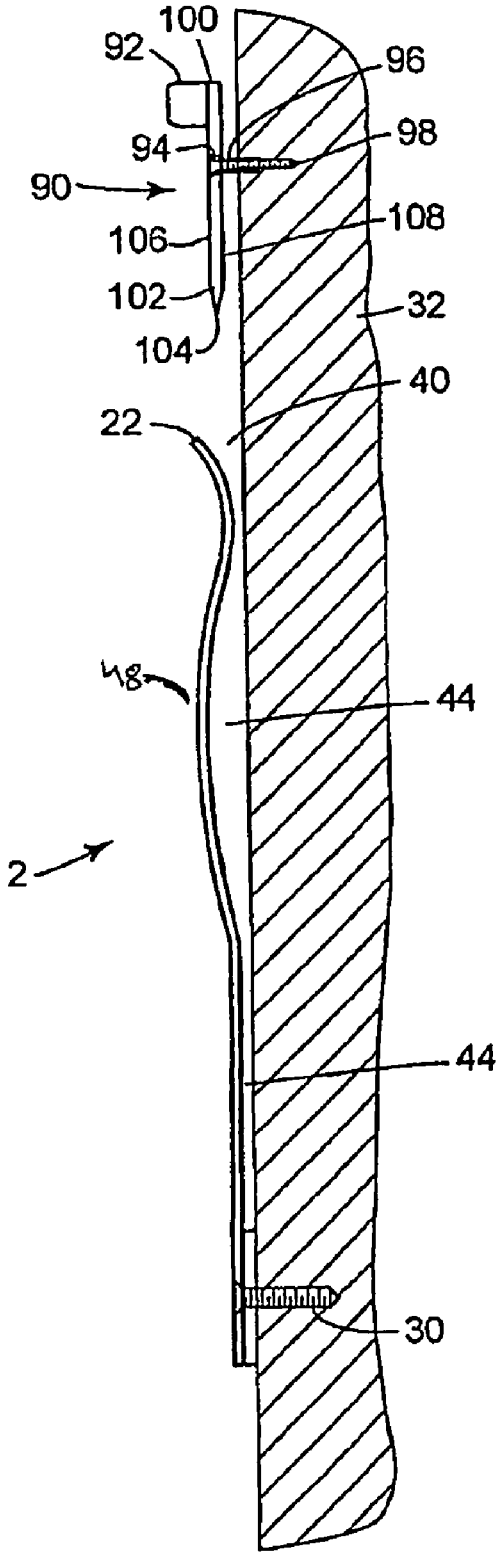
FIG. 7 is a sectional view of the box holder and the stabilizing member affixed to a mounting surface.

As particularly shown in FIGS. 7 and 8, the stabilizing member 90 is mounted in alignment with the box holder 2 on mounting surface 32 so that the bottom end 102 of the stabilizing member 90 and the front edge 22 of the box holder 2 face each other. The user should adjust the distance between the bottom end 102 of member 90 and the front edge 22 of the box holder 2 depending upon the size of the box 50 being mounted. For example, the distance may be less for a typical tissue box than for a box containing aluminum foil, which is generally larger. Thus, member 90 may be used not only in conjunction with tissue boxes but for larger boxes or for boxes containing heavier content, in order to provide additional stability to the box holder. Once the box 50 is mounted on the box holder 2, member 90 pivots around the screw 98, and the bottom end 102 of member 90 punctures the second end wall 60 of the box 50. The creation of the puncture is provided by the pointed tip 104 of the bottom end 102 and member 90 should be spaced so as only the pointed tip 104 of the bottom end 102 is inserted through the second end wall 60 and into the interior of the box 50. This is necessary in order to avoid disturbing the contents of the box 50.

Figure 10:
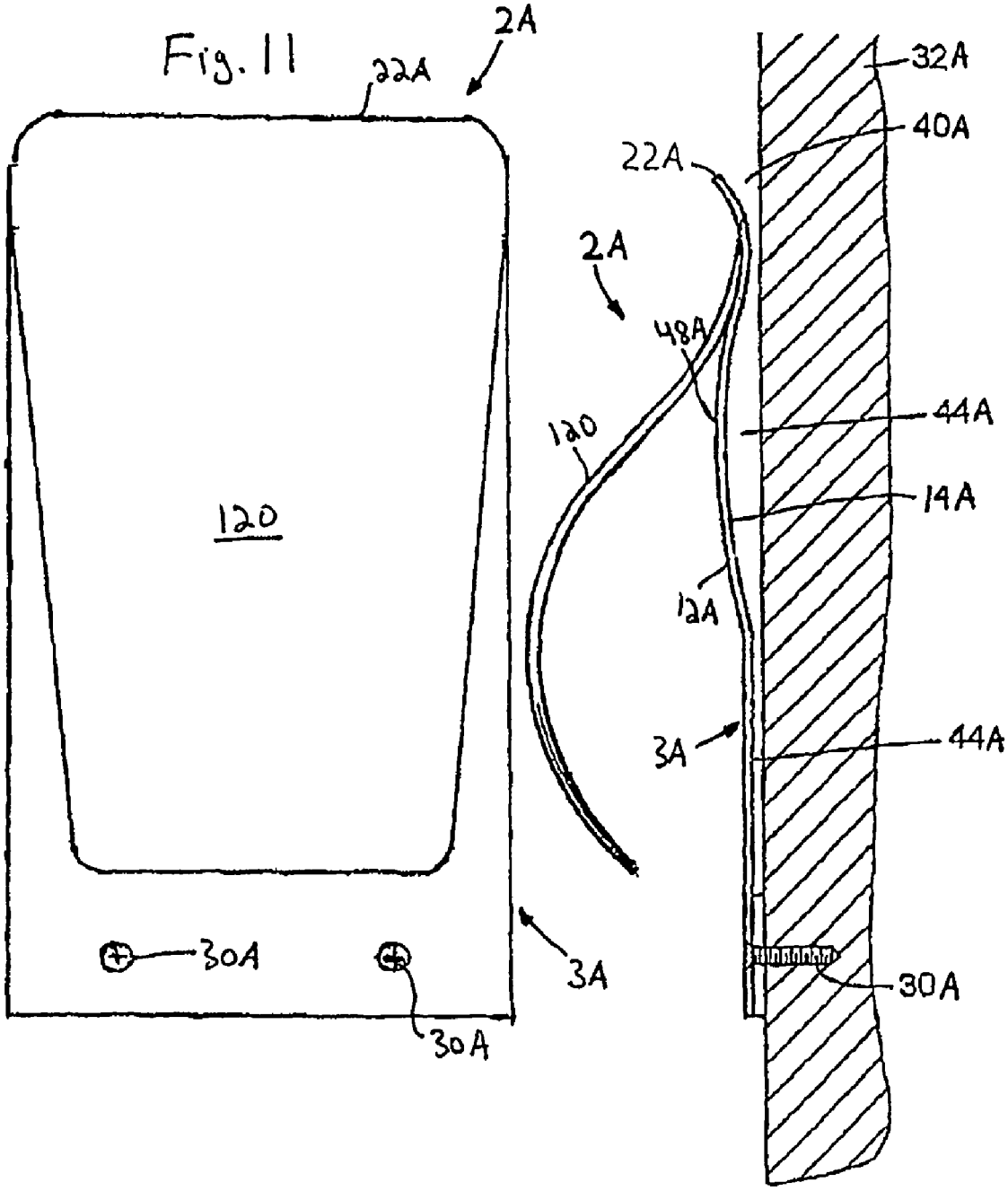
FIG. 10 is a sectional view of an alternate embodiment of a box holder affixed to a mounting surface.

Referring to FIGS. 10 and 11, an alternate embodiment of a box holder is shown. In many ways, the box holder illustrated in FIGS. 10 and 11 is similar to the box holder illustrated in FIGS. 1-9. At least some of the differences between the box holder embodiments will be described below. Those elements of the box holder illustrated in FIGS. 10 and 11 similar to elements of the box holder illustrated in FIGS. 1-9 are identified in the figures by the same reference number and an "A".

The box holder 2A includes a projecting member 120 extending from the front surface 12A of the plate 3A. The projecting member 120 can be unitarily formed with the plate 3A during manufacturing or the projecting member 120 can be formed separately from the plate 3A and connected to the plate 3A in temporary manners, such as, for example fastening, or in permanent manners, such as, for example welding, brazing, bonding, etc. Similar to the remainder of the box holder, the projecting member 120 can be made of plastic or metal. The projecting member 120 is insertable into the slot 70 in the box along with the plate 3A. The projecting member 120 is resilient and is operable to engage tissue paper within the box and bias the tissue paper toward the opening 64 where tissue paper is dispensed from the box. Upon initial insertion of the projecting member 120 and plate 3A into the slot 70, the full box of tissue paper compresses the projecting member 120 toward the plate 3A. Compression of the projecting member 120 generates a force from the projecting member 120 onto the tissue paper. As the tissue paper is removed from the box, the projecting member 120 is allowed to move away from the plate 3A and continues to exert a biasing force on the remaining tissue paper in a direction toward the dispensing opening 64. The force exerted on the tissue paper by the projecting member 3A maintains the tissue paper in a position adjacent to the dispensing opening 64 of the box, thereby facilitating easy, consistent, and efficient removal of the tissue paper from the box. In the illustrated embodiment, the projecting member 120 has a smooth arcuate shape. Alternatively, the projecting member 120 can have different shapes, such as, for example linear, and still be within the spirit and scope of the present invention.

Although the box holder disclosed herein is particularly well suited to tissue boxes, persons of ordinary skill in the art will readily appreciate that the teachings herein are in no way limited to such boxes. Persons of ordinary skill in the art will readily appreciate that the box holder can be used to mount containers of other contents such as aluminum foil, latex gloves, and other household or medical products. Furthermore, persons of ordinary skill in the art will readily appreciate that the box holder can be used to mount a box in a variety of orientations, including horizontally, vertically, and upside down.

Many other modifications and substitutions to the embodiments described herein could be made. The scope of some changes is discussed above. The scope of others will become apparent from the appended claims.

What is claimed is:

1. A box holder configured to mount a box on a mounting surface, the box having a wall and an opening formed in the wall configured to receive the box holder, the box holder comprising:

a plate member, the plate member including a top surface and a bottom surface, the bottom surface facing the mounting surface, the plate member further including an upper portion connected to a base portion, the upper portion of the plate member being received in the opening of the box, the base portion including a fastener mechanism configured to attach the box holder to the mounting surface and a spacing member configured to provide a space between the bottom surface of the box holder and the mounting surface for accommodating a portion of the wall of the box, and wherein the base portion includes an extension and the spacing member includes the extension of the base portion folded into abutting engagement with the bottom surface of the plate member to space the bottom surface of the plate member away from the mounting surface when the plate member is attached to the mounting surface.

2. The box holder of claim 1 wherein the plate member has a substantially rectangular shape.

3. The box holder of claim 1 wherein the plate member is made of plastic or metal.

4. The box holder of claim 1 wherein the upper portion of the plate member includes a forwardly extending front edge configured to be received in the opening formed in a wall of the box.

5. The box holder of claim 4, wherein the front edge includes a first rounded corner formed at a junction of the front edge and a first side edge of the plate member, and a second rounded corner formed at a junction of the front edge and a second side edge of the plate member.

6. The box holder of claim 1 wherein the box contains facial tissues.

7. The box holder of claim 1, wherein the fastener mechanism includes at least one hole in the base portion to receive nails or screws.

8. The box holder of claim 1, wherein the fastener mechanism includes an adhesive located on the bottom surface of the base portion of the plate member for adhering the plate member to the mounting surface.

9. The box holder of claim 1, wherein the spacing member includes an arched upper portion.

10. The box holder of claim 1, further comprising a stabilizing member, the stabilizing member being couplable to the mounting surface a spaced distance from the plate member and being moveable into engagement with the box to provide additional support for the box when the box is mounted on the plate member.

11. The box holder of claim 1 wherein the fastener mechanism includes at least one hole extending through the base portion and folded extension.

12. The box holder of claim 1 wherein the top surface of the plate member includes at least one reinforcing rib.

13. The box holder of claim 1 further comprising a projecting member extending from the top surface of the plate member and being received in the opening of the box along with the plate member.

14. The box holder of claim 13 wherein the projecting member is resilient and is made of plastic or metal.

15. The box holder of claim 13 wherein the box contains facial tissue and wherein the projecting member engages the facial tissue in the box and biases the facial tissue toward a side of the box.

16. A method for mounting a box to a mounting surface, the method comprising:

(a) forming an opening in the box, (b) mounting a box holder including a plate member, the plate member including a top surface and a bottom surface, the bottom surface facing the mounting surface, the plate member further including an upper portion connected to a base portion, the upper portion of the plate member being received in the opening of the box, the base portion including a fastener mechanism configured to attach the box holder to the mounting surface and a spacing member configured to provide a space between the bottom surface of the box holder and the mounting surface for accommodating a portion of the wall of the box onto the mounting surface using a fastener mechanism, wherein a base portion of the plate member includes an extension and a spacing member, the spacing member including the extension of the base portion folded into abutting engagement with the bottom surface of the plate member to space the bottom surface of the plate member away from the mounting surface, (c) aligning the opening on the box with an upper portion of a plate member of the box holder, (d) inserting the upper portion of the plate member through the opening, the insertion facilitated by the spacing member, and (e) accommodating the wall of the box in the space between a bottom surface of the plate member and the mounting surface.

17. The method of claim 16 wherein the upper portion of the plate member includes a forwardly extending front edge configured to be received in the slot formed in the wall of the box, wherein the front edge includes a first rounded corner formed at a junction of the front edge and a first side edge of the plate member, and a second rounded corner formed at a junction of the front edge and a second side edge of the plate member.

18. The method of claim 16 wherein the fastening mechanism includes at least one hole extending through the base portion and folded lower extension and a screw or nail extending through the hole.

19. A box holder configured to mount a box on a mounting surface, the box having a wall and an opening formed in the wall configured to receive the box holder, the box holder comprising:

a plate member, the plate member including a top surface and a bottom surface, the bottom surface facing the mounting surface, the plate member further including an upper portion connected to a base portion, the upper portion of the plate member being received in the opening of the box, the base portion including a fastener mechanism configured to attach the box holder to the mounting surface and a spacing member configured to provide a space between the bottom surface of the box holder and the mounting surface for accommodating a portion of the wall of the box, and wherein the spacing member includes a depressed rim surrounding a hole configured to receive a nail or a screw, and wherein the depressed rim includes an abutment surface configured to contact the mounting surface.

20. A holder configured to mount a box on a mounting surface, the box containing prepackaged contents, at least one side wall, and a bottom wall defining a slot, the box holder comprising:

a plate member, the plate member including a top surface and a bottom surface, the bottom surface facing the mounting surface, the plate member further including an upper portion at least partially curved and a base portion, the upper portion of the plate member being received in the slot of the box such that the upper portion is positioned between the bottom wall and the contents, and the base portion including a fastener mechanism configured to attach the box holder to the mounting surface such that the upper portion of the plate member maintains the position of the box with respect to a support surface regardless the orientation of the support surface.

21. The holder of claim 20, wherein the prepackaged contents include a plurality of tissues.

* * * * *